US008040073B2

(12) United States Patent
Kimura

(10) Patent No.: US 8,040,073 B2
(45) Date of Patent: Oct. 18, 2011

(54) AC POWER SUPPLY SYSTEM FOR BALANCED ENERGIZATION OF A PLURALITY OF LOADS

(75) Inventor: Kengo Kimura, Saitama (JP)

(73) Assignee: Sanken Electric Co., Ltd. (JP)

( * ) Notice: Subject to any disclaimer, the term of this patent is extended or adjusted under 35 U.S.C. 154(b) by 378 days.

(21) Appl. No.: 12/186,062

(22) Filed: Aug. 5, 2008

(65) Prior Publication Data

US 2009/0039800 A1 Feb. 12, 2009

(30) Foreign Application Priority Data

Aug. 10, 2007 (JP) ..... 2007-209585

(51) Int. Cl.
*H05B 41/16* (2006.01)

(52) U.S. Cl. ..... 315/282; 315/274; 315/224; 315/312; 315/291

(58) Field of Classification Search ..... 315/247, 315/246, 224, 225, 274–289, 291, 297, 307–326, 315/185 S See application file for complete search history.

(56) References Cited

U.S. PATENT DOCUMENTS

| | | | | |
|---|---|---|---|---|
| 2007/0052370 | A1* | 3/2007 | Huang | 315/277 |
| 2007/0114953 | A1* | 5/2007 | Kim et al. | 315/307 |
| 2007/0247082 | A1* | 10/2007 | Ashikaga et al. | 315/277 |
| 2007/0273300 | A1* | 11/2007 | Usui | 315/274 |
| 2008/0061711 | A1* | 3/2008 | Jin | 315/277 |
| 2009/0001898 | A1* | 1/2009 | Otsuki et al. | 315/169.4 |
| 2010/0060191 | A1* | 3/2010 | Ashikaga et al. | 315/291 |

FOREIGN PATENT DOCUMENTS

| | | |
|---|---|---|
| JP | 05242987 | 9/1993 |
| JP | 11238589 | 8/1999 |

* cited by examiner

*Primary Examiner* — Tuyet Thi Vo
(74) *Attorney, Agent, or Firm* — Woodcock Washburn LLP

(57) ABSTRACT

A gas-discharge lamp igniter is disclosed which has a group of gas-discharge lamps, such as those for LCD backlighting, connected in parallel with one another between the pair of outputs of an AC power supply. Provided one for each lamp to be energized, current-balancing transformers have their secondary windings serially interconnected. The lamps are connected to one of the pair of outputs of the AC power supply via the respective primary windings of the current-balancing transformers and the serial connection of the secondary windings thereof.

7 Claims, 7 Drawing Sheets

AC POWER SUPPLY SYSTEM FOR BALANCED ENERGIZATION OF A PLURALITY OF LOADS

CROSS REFERENCE TO RELATED APPLICATIONS

This application claims priority to Japanese Patent Application No. 2007-209585, filed Aug. 10, 2007.

BACKGROUND OF THE INVENTION

This invention relates generally to electrical power supplies, and more particularly to a power supply system for feeding a plurality of loads such for example as electric-discharge lamps or gas-discharge lamps, featuring provisions for automatically balancing the currents fed to such loads.

Gas-discharge lamps such as cold-cathode fluorescent lamps (CCFLs) find extensive use for liquid crystal display (LCD) backlighting and other applications. Such lamps are lit up by an igniter incorporating a high frequency inverter, as disclosed in Japanese Unexamined Patent Publication No. 5-242987.

Built to the same stringent manufacturing specifications, the individual gas-discharge lamps might nevertheless differ in impedance and so incur an unequal flow of current therethrough. The result, in the case of LCD backlights, would be uneven display screen brightness. Japanese Unexamined Patent Publication No. 11-238589 represents a conventional remedy (shown in FIG. 1 of the drawings attached hereto) for this problem. It teaches a gas-discharge lamp igniter wherein each two lamps are connected between the pair of output terminals of an AC power supply via a pair of windings, respectively of one current-balancing transformer. Each pair of current-balancing transformer windings are interconnected, and each two pairs of current-balancing transformer windings are connected to one of the pair of output terminals of the AC power supply via an additional pair of current-balancing transformer windings, respectively. In short the lamps are energized under cascade control of the current-balancing transformers. Each pair of current-balancing transformer windings are oppositely polarized.

All such current-balancing transformers used in the gas-discharge lamp igniter are not free from some inherent fluctuations in performance. These performance fluctuations, be they ever so slight in individual transformers, become aggravated as the balancing of the lamp energization is sought to be attained by cascade connection of current-balancing transformers as in the prior art cited above. It has indeed sometimes occurred for the gas-discharge lamps to glow with unequal intensity for this reason.

SUMMARY OF THE INVENTION

The present invention has it as an object to accomplish a well balanced energization of a plurality of loads without any such aggravation of fluctuations in transformer performance resulting from the conventional cascade connection of current-balancing transformers.

Briefly, the invention may be summarized as an AC power supply system for balanced energization of a plurality of loads as typified by gas-discharge lamps. Included is AC power supply means having a pair of outputs to be connected to each of the loads. Provided one for each load, a plurality of current-balancing transformers have each a primary winding and a secondary winding electromagnetically coupled together. The secondary windings of the current-balancing transformers are serially connected to one another. The loads to be jointly energized are to be connected between the pair of outputs of the AC power supply means via the respective primary windings of the current-balancing transformers and the serial connection of the secondary windings thereof.

Assuming that all the gas-discharge lamps have the same impedance, the lamp currents flowing through the respective lamps will be of the same magnitude. It is the sum of all these lamp currents that flows through the serially interconnected secondary windings of the current-balancing transformers. The ratio of the primary and the secondary turns of each current-balancing transformer is so predetermined that, normally, the primary and secondary circuits of each transformer are of the same ampere-turns. The magnetic fluxes generated by the primary and secondary windings counterbalance each other, permitting the flow of the same lamp current through all the lamps.

However, should any one of the lamps be higher in impedance than normal, and therefore less in the lamp current flowing therethrough, then the magnetic flux generated by the primary of the current-balancing transformer connected to that higher-impedance lamp will be less than that of the secondary of the same transformer. This difference in magnetic flux will cause a corresponding increase in the voltage across the transformer primary, causing a rise in the lamp current until it becomes balanced with the lamp currents of the other lamps.

The invention requires single-stage transformers connected in series with the respective loads to be jointly energized. Therefore, no matter how many these loads are, no aggravation of inherent fluctuations in transformer performance is to take place. A more accurately balanced energization of electric-discharge lamps or the like is thus accomplished by the invention than by the prior art having current-balancing transformers in cascade connection.

The above and other objects, features and advantages of this invention will become more apparent, and the invention itself will best be understood, from a study of the following detailed description and appended claims, with reference had to the attached drawings showing the closest prior art and some preferable embodiments of the invention.

DETAILED DESCRIPTION

Figure 1:
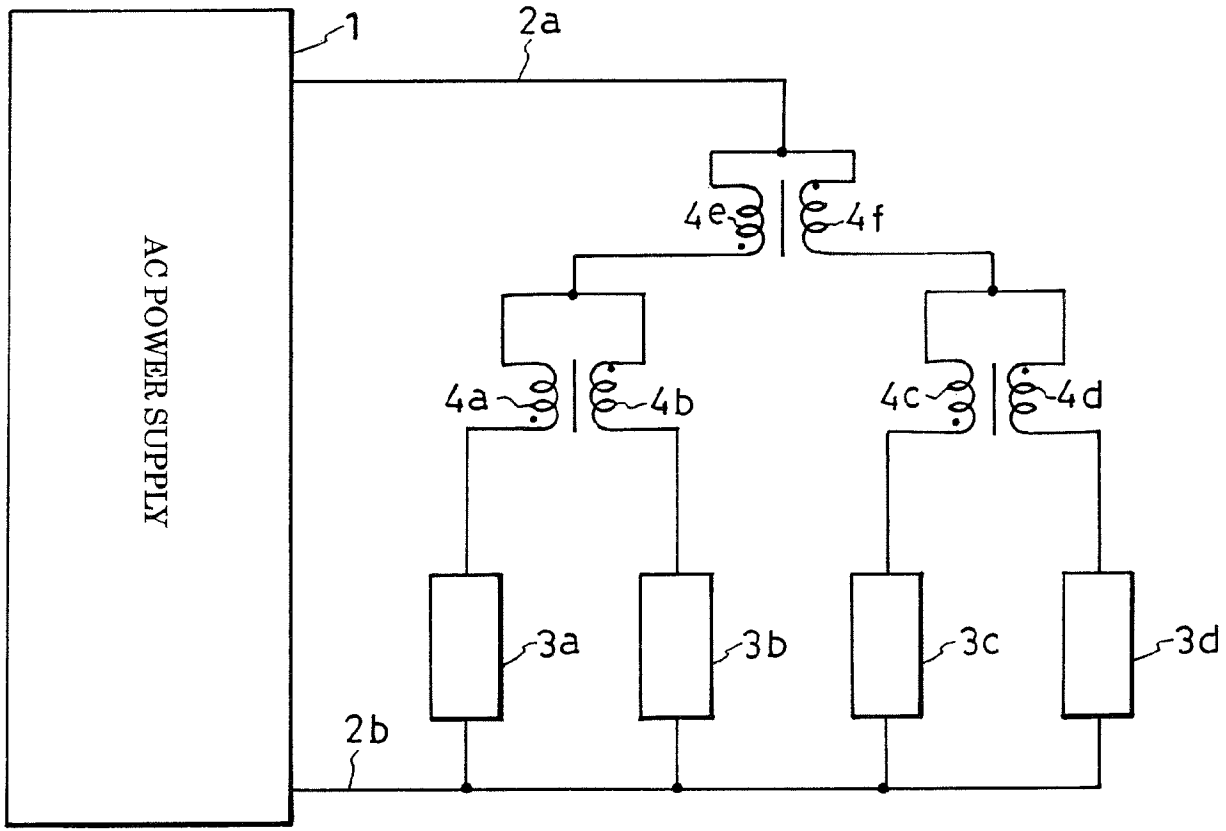
FIG.1 PRIOR ART
FIG. 1 is a schematic electrical diagram, partly in block form, of the prior art gas-discharge lamp igniter.

The features and advantages of the instant invention will be better understood by first briefly reconsidering the prior art gas-discharge lamp igniter proposed by Japanese Unexamined Patent Publication No. 11-238589, supra, and illustrated in FIG. 1 of the above drawings. At 1 in this figure is seen an AC power supply network comprising a rectifier circuit, an inverter circuit and a resonant circuit. A plurality of, four shown, gas-discharge lamps $\mathbf{3}_a$, $\mathbf{3}_b$, $\mathbf{3}_c$ and $\mathbf{3}_d$ are connected between the pair of outputs $\mathbf{2}_a$ and $\mathbf{2}_b$ of the AC power supply network 1. The first two gas-discharge lamps $\mathbf{3}_a$ and $\mathbf{3}_d$ are both connected to the power supply output $\mathbf{2}_b$ on one hand and, on the other hand, respectively to a first pair of current-balancing transformer windings $\mathbf{4}_a$ and $\mathbf{4}_b$. The other two gas-discharge lamps $\mathbf{3}_c$ and $\mathbf{3}_d$ are likewise connected to the power supply output $\mathbf{2}_b$ on one hand and, on the other hand, respectively to a second pair of current-balancing transformer windings $\mathbf{4}_c$ and $\mathbf{4}_d$.

The other extremities of the first pair of current-balancing transformer windings $\mathbf{4}_a$ and $\mathbf{4}_b$, and those of the second pair of current-balancing transformer windings $\mathbf{4}_c$ and $\mathbf{4}_d$, are connected to the power supply output $\mathbf{2}_a$ via a third pair of current-balancing transformer windings $\mathbf{4}_e$ and $\mathbf{4}_f$, respectively. As indicated by the dots in FIG. 1, each pair of transformer windings are oppositely polarized.

Thus, in event the current flowing through the first lamp $\mathbf{3}_a$ grows less in magnitude than that of the second $\mathbf{3}_b$, a voltage will be induced in the winding $\mathbf{4}_a$ in a direction to boost the current flowing through the first lamp $\mathbf{3}_a$. The consequent rise in the current of this first lamp $\mathbf{3}_a$ will cause a drop in the current of the second lamp $\mathbf{3}_b$. The currents flowing through both lamps $\mathbf{3}_a$ and $\mathbf{3}_b$ will thus be balanced. The same balancing action will take place between the other two lamps $\mathbf{3}_c$ and $\mathbf{3}_d$.

A current imbalance may also occur between one pair of lamps $\mathbf{3}_a$ and $\mathbf{3}_b$ and the other pair of lamps $\mathbf{3}_c$ and $\mathbf{3}_d$. Thereupon the third pair of current-balancing transformer windings $\mathbf{4}_e$ and $\mathbf{4}_f$ will function in a like fashion to regain current equilibrium between the two pairs of lamps.

The problem with this type of gas-discharge lamp igniter is that no two transformers are exactly alike in performance characteristics. The performance fluctuations of each transformer tend to be added together or amplified as they are cascade connected as in this known power supply system. The balanced energization of the lamps will become even more difficult with an increase in the number of the lamps to be jointly energized and hence in that of the transformer stages.

Figure 2:
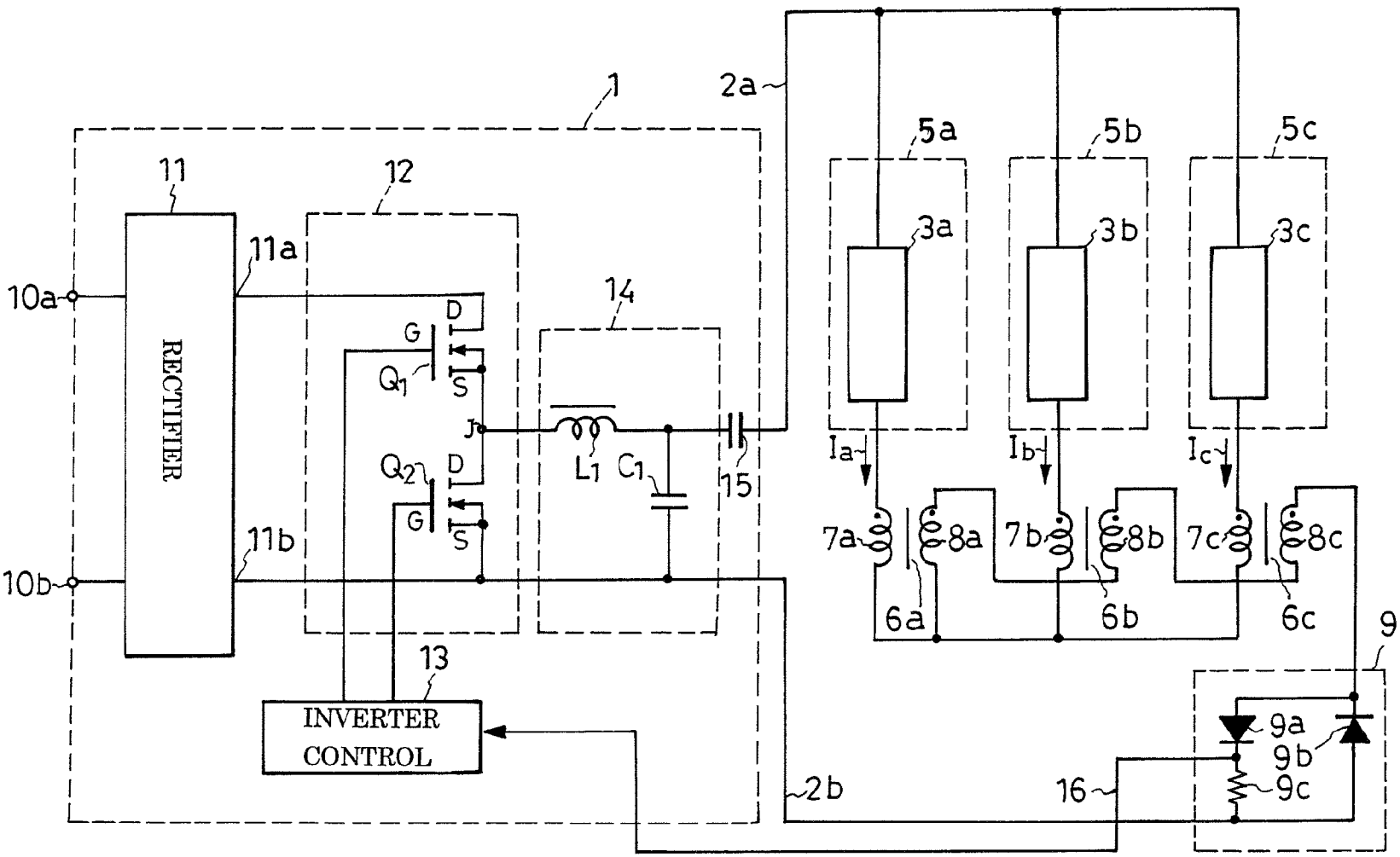
FIG. 2 is a schematic electrical diagram, partly in block form, of the gas-discharge lamp igniter embodying the novel principles of this invention.

Embodiment of FIG. 2

Figure 3:
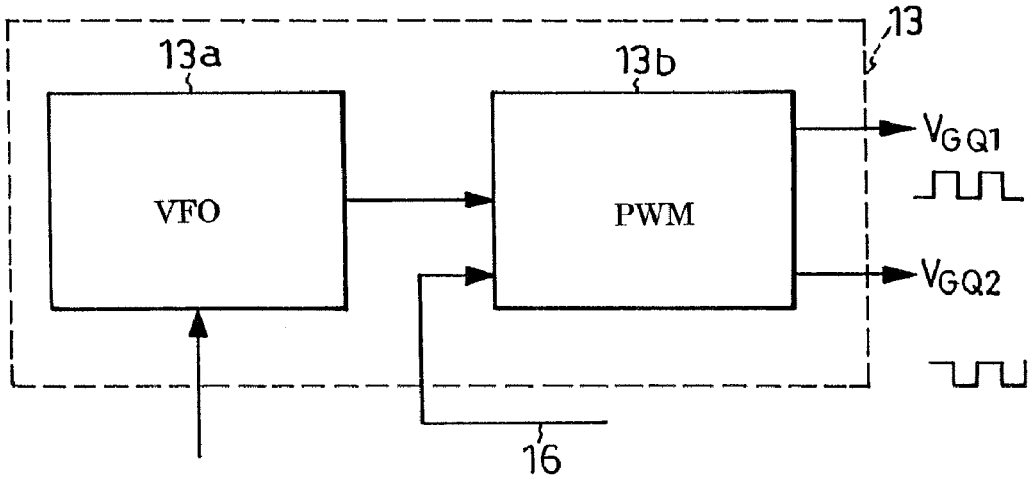
FIG. 3 is a block diagram showing in more detail the inverter control circuit of the AC power supply network in the gas-discharge lamp igniter of FIG. 2.
Figure 4:
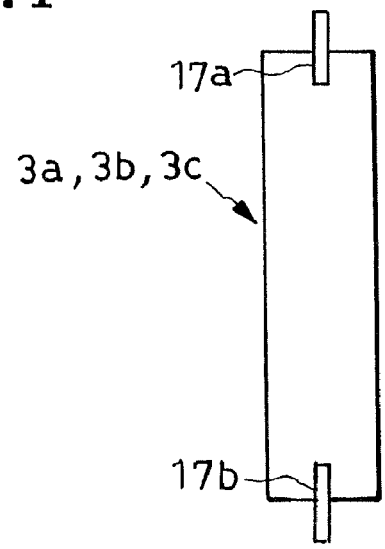
FIG. 4 is a schematic illustration of each of the gas-discharge lamps used with the igniter of FIG. 2.

This drawback of the prior art is absent from the improved balanced power supply system of this invention schematically diagramed in its entirety in FIG. 2. Reference will also be had to FIGS. 3 and 4 in the course of the following explanation of this first embodiment of the invention. With reference to FIG. 2 the balanced power supply system according to the invention broadly comprises:

1. An AC power supply network 1 having a pair of output conductors $\mathbf{2}_a$ and $\mathbf{2}_b$ for energizing with lamp currents $I_a$, $I_b$ and $I_c$ plurality of, three shown, load circuits $\mathbf{5}_a$, $\mathbf{5}_b$ and $\mathbf{5}_c$ which include electric-discharge lamps or gas-discharge lamps $\mathbf{3}_a$, $\mathbf{3}_b$ and $\mathbf{3}_c$ in this particular embodiment of the invention.

2. Current-balancing transformers $\mathbf{6}_a$, $\mathbf{6}_b$ and $\mathbf{6}_c$ connected respectively to the gas-discharge lamps $\mathbf{3}_a$, $\mathbf{3}_b$ and $\mathbf{3}_c$ for automatically balancing the lamp currents $I_a$-$I_c$.

3. A current detector circuit 9 for maintaining the sum of the lamp currents $I_a$-$I_c$ within limits by feedback control of the AC power supply network 1.

Itself of conventional make, the AC power supply network 1 comprises a rectifier circuit 11, an inverter circuit 12, an inverter control circuit 13, a resonant circuit 14, and a coupling capacitor 15. The rectifier circuit 11 is connected to a pair of AC input terminals $\mathbf{10}_a$ and $\mathbf{10}_b$ for translating the commercial AC voltage into a DC voltage.

The inverter circuit 12 of the AC power supply network 1 is of half-bridge construction, having two semiconductor switches $Q_1$ and $Q_2$ connected in series between the pair of outputs $\mathbf{11}_a$ and $\mathbf{11}_b$ of the rectifier circuit 11. The switches $Q_1$ and $Q_2$ are both shown as insulated-gate field-effect transistors (IGFETs), each having a source connected to its substrate. As is well known, each IGFET has a parasitic diode connected in parallel therewith between source S and drain D. Current flows through this parasitic diode from source S to drain D when the source is higher in potential than the drain.

Alternative constructions are possible for the IGFET switches; for example, a discrete diode might be connected reversely in parallel with each semiconductor switch. Other types of semiconductor switches are of course adoptable, such as bipolar transistors and insulated-gate bipolar transistors.

The resonant circuit 14, more commonly known as LC circuit, is a combination of an inductor $L_1$ and a capacitor $C_1$. The capacitor $C_1$ is connected in parallel with the second switch $Q_2$ of the inverter circuit 12 via the inductor $L_1$, although the resonant circuit 14 could be connected in parallel with the first switch $Q_1$. As the switches $Q_1$ and $Q_2$ go on and off, the capacitor $C_1$ will be charged and discharged. A sinusoidal voltage will thus develop across the capacitor $C_1$ and be put out over the pair of output conductors $\mathbf{2}_a$ and $\mathbf{2}_b$ via the coupling capacitor 15, the latter being effective to filter out the DC component from the output voltage. The coupling capacitor might be connected between the junction J of the switches $Q_1$ and $Q_2$ and the inductor $L_1$, instead of in the position indicated.

It is understood that the gas-discharge lamps $\mathbf{3}_a$-$\mathbf{3}_c$ are being used in an LCD and hence of the same voltage, current, and power ratings and the same electromechanical design. However, no matter how faithfully they are manufactured to the preordained specifications, these lamps have some fluctuations in electrical characteristics. Notably, their impedances are ordinarily not equal but differ within the given manufacturing tolerance.

While the lamps $\mathbf{3}_a$-$\mathbf{3}_b$ may take any of the known or suitable forms within the broad family of gas-discharge lamps, CCFLs may preferentially be adopted in the application now under consideration. As schematically pictured in FIG. 4, each CCFL has a pair of electrodes $\mathbf{17}_a$ and $\mathbf{17}_b$ across a hermetically sealed space.

All the lamps $\mathbf{3}_a$-$\mathbf{3}_c$ are connected between the pair of outputs $\mathbf{2}_a$ and $\mathbf{2}_b$ of the AC power supply network 1 via the current-balancing transformers $\mathbf{6}_a$, $\mathbf{6}_b$ and $\mathbf{6}_c$, respectively, and the current detector circuit 9. The lamps $\mathbf{3}_a$-$\mathbf{3}_b$ are in parallel with one another.

The current-balancing transformers $\mathbf{6}_a$-$\mathbf{6}_c$ have primary windings $\mathbf{7}_a$-$\mathbf{7}_c$ and secondary windings $\mathbf{8}_a$-$\mathbf{8}_c$ electromagnetically coupled to each other. The transformer primaries $\mathbf{7}_a$-$\mathbf{7}_c$ are connected between the lamps $\mathbf{3}_a$-$\mathbf{3}_c$ and the second output $\mathbf{2}_b$ of the AC power supply network 1 via the current detector circuit 9. The currents $I_a$, $I_b$ and $I_c$ from the lamps $\mathbf{3}_a$-$\mathbf{3}_c$ flow through the transformer primaries $\mathbf{7}_a$-$\mathbf{7}_c$, respectively. The ratio $N_1/N_2$ of the numbers of turns in the primary and secondary of each of the current-balancing transformers $6_a$-$6_c$ is n/1 where n is the number of the lamps in use. Since three lamps $3_a$-$3_c$ are shown to be in use in this embodiment of the invention, the ratio $N_1/N_2$ here is 3/1.

The present invention proposes, for balanced energization of all the lamps $3_a$-$3_c$, a serial connection of the secondaries $8_a$-$8_c$ of all the current-balancing transformers $6_a$-$6_c$. Thus the first transformer secondary $8_a$ has one extremity connected to one extremity of the first transformer primary $7_a$, the other extremity of which is connected to the first lamp $3_a$. The second transformer secondary $8_b$ has one extremity connected to the other extremity of the first transformer secondary $8_a$. The third transformer secondary $8_c$ has one extremity connected to the other extremity of the second transformer secondary $8_b$. The other extremity of the third transformer secondary $8_c$ is connected to the second output $2_b$ of the AC power supply network 1 via the current detector circuit 9. As indicated by the dots in FIG. 2, the primary and secondary windings of each of the current-balancing transformers $6_a$-$6_c$ are polarized in the same direction.

An AC voltage with a frequency higher than that of the AC supply terminals $10_a$ and $10_b$ will develop between the pair of outputs $2_a$ and $2_c$ of the AC power supply network 1 when the inverter circuit 12 is conventionally driven from the inverter control circuit 13. All the gas-discharge lamps $3_a$-$3_c$ will glow when energized from the AC power supply network 1.

Let us suppose that the three lamps $3_a$-$3_b$ are all the same in impedance. Then the lamp current $I_a$, $I_b$ and $I_c$ flowing through these lamps will be of the same magnitude. Further, if $I_o$ is the sum of the lamp currents $I_a$-$I_c$, then $I_a=I_b=I_c=I_o/3$. Since the ratio $N_1/N_2$ of the numbers of turns in the primary and secondary windings of each of the current-balancing transformers $6_a$-$6_c$ is three, the primary and secondary sides of these transformers are of the same ampere-turns. Therefore, in each current-balancing transformer, the primary and the secondary magnetic flux will exactly counterbalance each other. No additional voltage will be induced in the transformer primaries $7_a$-$7_c$. All the lamp currents $I_a$-$I_c$ are in equilibrium.

Let it now be assumed that the lamp current $I_a$ energizing the first lamp $3_a$ is less than normal because of a higher impedance of that lamp, whereas the other lamps $3_b$ and $3c$ are being fed with normal lamp currents $I_b$ and $I_c$. Then the ampere-turns $N_1 \times I_a$ of the primary $7_a$ of the first current-balancing transformer $6_a$ will have a value less than that of the ampere-turns $N_2 \times I_o$ of the secondary $8_a$ of the same transformer. A difference will then occur between the magnetic fluxes of the first current-balancing transformer windings $7_a$ and $8_a$, resulting in the development of a voltage across the transformer primary $7_a$ which is added to the voltage between the pair of outputs $2_a$ and $2_b$ of the AC power supply network 1 for joint application to the first lamp $3_a$. The lamp current $I_a$ flowing through the first lamp $3_a$ will then be boosted until it grows equal to the other lamp currents $I_b$ and $I_c$. Thus the three lamps $3_a$-$3_c$ will start glowing with equal intensity.

The lamp current $I_a$ of the first lamp $3_a$ will be greater than normal if the impedance of the first lamp is less than normal. Then a voltage will develop across the first current-balancing transformer primary $7_a$ in a direction to lessen the voltage applied to the first lamp $3_a$, so that the lamp current $I_a$ will return to normal. It is self-evident that a similar balancing action takes place in the cases where the other lamps $3_b$ and $3_c$ are abnormally high or low in impedance.

The current detector circuit 9 as current detector means comprises two diodes $9_a$ and $9_b$ connected reversely in parallel with each other on the path of the total lamp current $I_o$, and a resistor $9_c$ connected in series with the diode $9_a$. A total lamp current signal, a voltage indicative of the total lamp current $I_o$, is obtained across the resistor $9_c$ to be fed back over the conductor 16 to the inverter control circuit 13.

As block-diagrammatically depicted in FIG. 3, the inverter control circuit 13 comprises a variable frequency oscillator (VFO) $13_a$ and pulse width modulator (PWM) $13_b$. The PWM $13_b$ modulates the width of the incoming VFO signal according to the total lamp current signal from the current detector circuit 9 in order to hold the total lamp current $I_o$ within prescribed limits. The PWM $13_b$ supplies the first control signal $V_{GQ1}$ to the gate of the first switch $Q_1$, and supplies the second control signal $V_{GQ2}$ to the gate of the second switch $Q_2$. The first and second switches $Q_1$ and $Q_2$ operate on the contrary mutually.

Notwithstanding the showings of FIGS. 1 and 2, however, the feedback control of the power delivered to the lamps $3_a$-$3_c$ is not an essential feature of this invention. The current-balancing means according to the invention will be fully functional without the feedback loop.

It will be appreciated that the invention realizes a balanced energization of the lamps $3_a$-$3_c$ merely by connecting single-stage transformers $6_a$-$6_c$ in series with the respective lamps. No aggravation of fluctuations in the performance of these transformers is to takes place as they are not cascaded as in the prior art of FIG. 1. A highly reliable equalization of the lamp currents $I_a$-$I_c$ is attained through the relatively simple configuration of current-balancing transformers. Such improved equalization of the lamp currents lead to improved uniformity in the brightness of the display screen. The lamps will be energized even more stably by feedback control of the output from the AC power supply network 1.

Figure 5:
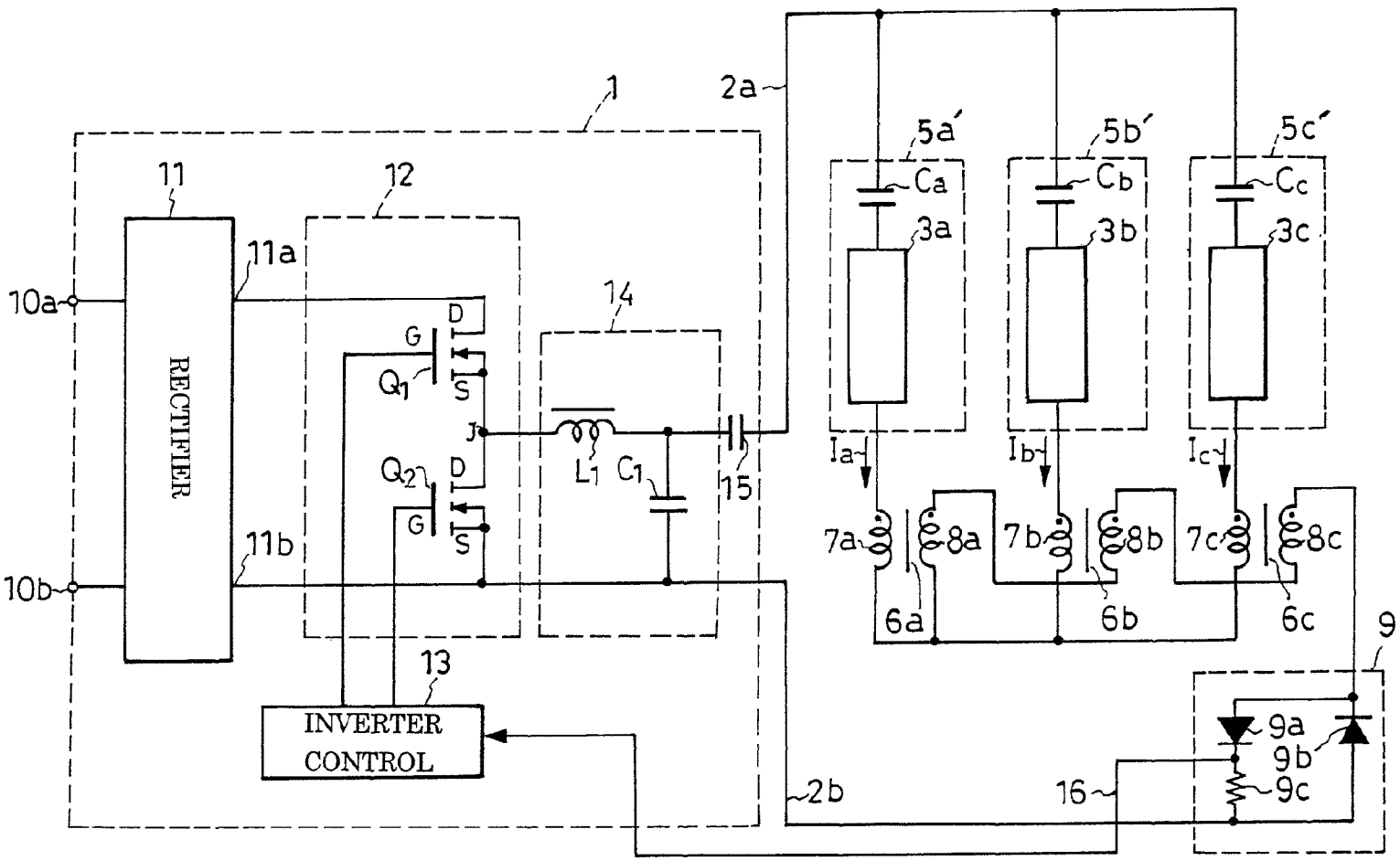
FIG. 5 is a diagram similar to FIG. 2 but showing another preferred form of gas-discharge lamp igniter according to the invention.

Embodiment of FIG. 5

The gas-discharge lamp igniter shown here is of the same construction as that of FIG. 2 except for modifications in load circuits $5_a'$, $5_b'$ and $5_c'$. The modified load circuits $5_a'$-$5_c'$ incorporate ballast capacitors $C_a$, $C_b$ and $C_c$ connected in series with the gas-discharge lamps $3_a$, $3_b$ and $3_c$, respectively.

As disclosed for example in the aforementioned Japanese Unexamined Patent Publication No. 11-238589, the ballast capacitors $C_a$-$C_c$ serve to boost by resonance the voltages impressed to the lamps $3_a$-$3_c$ and hence to let them glow more stably. The coupling capacitor 15 of the AC power supply network 1 may be unnecessary as the ballast capacitors $C_a$-$C_c$ serve the additional purpose of eliminating the unidirectional components from the currents being fed to the lamps $3_a$-$3_c$. Resonant circuits each comprising a serial connection of a capacitor and an inductor might be adopted in substitution for the ballast capacitors $C_a$-$C_c$.

The other benefits of this lamp igniter are as set forth above in conjunction with the embodiment of FIG. 2.

Figure 6:
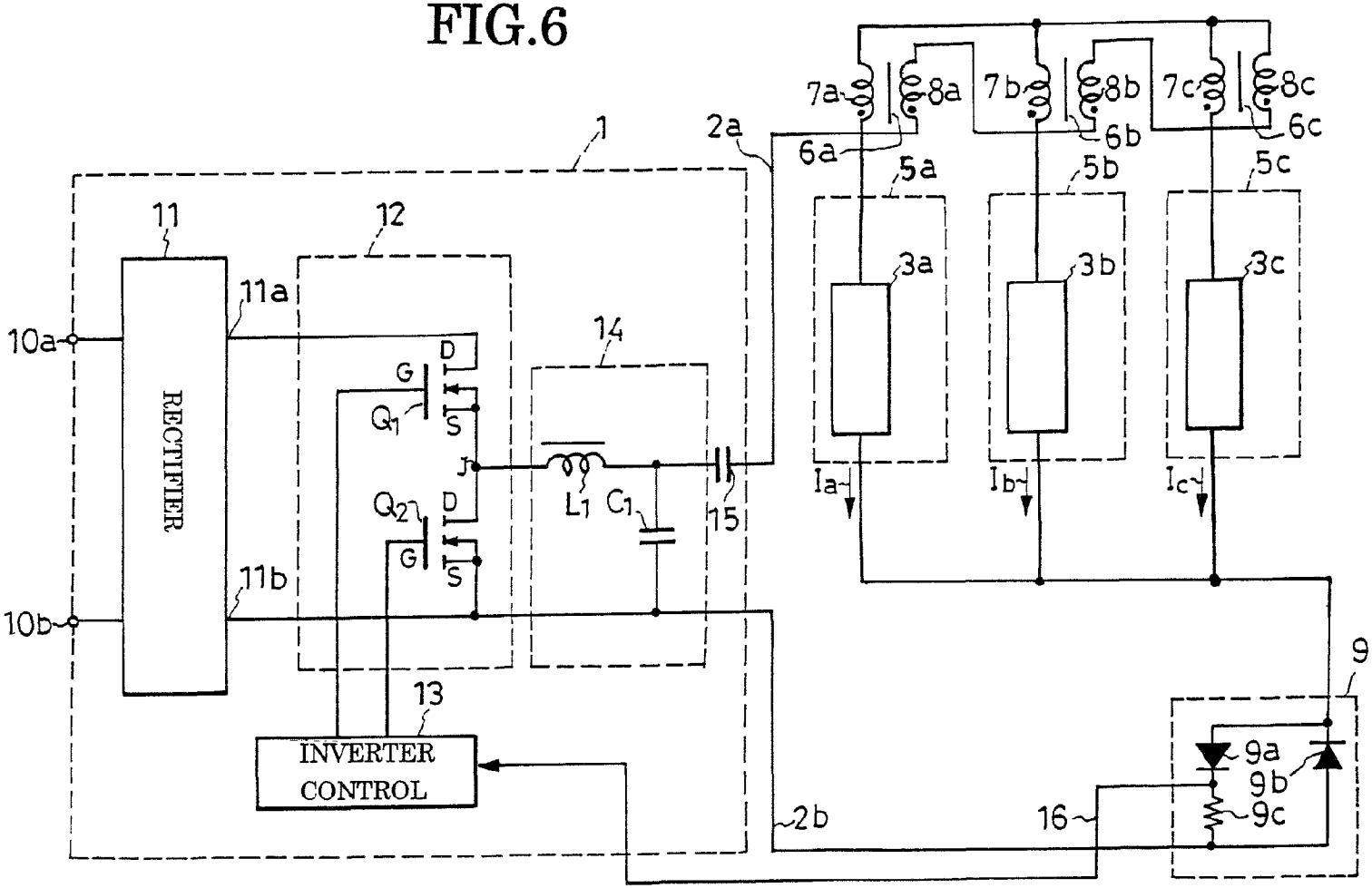
FIG. 6 is a diagram similar to FIG. 2 but showing still another preferred form of gas-discharge lamp igniter according to the invention.

Embodiment of FIG. 6

This embodiment differs from that of FIG. 2 only in that the current-balancing transformers $6_a$-$6_c$ are connected between the first output $2_a$ of the AC power supply network 1 and the load circuits $5_a$-$5_c$. Thus the gas-discharge lamps $3_a$-$3_c$ are connected to the AC power supply output $2_a$ via the respective transformer primaries $7_a$-$7_c$ and the serial connection of the transformer secondaries $8_a$-$8_c$. The lamps $3_a$-$3_b$ are connected on the other hand to the second output $2_b$ of the AC power supply network 1 via the current detector circuit 9.

Being identical with the embodiment of FIG. 2 in all the other details of construction, this embodiment gains the same advantages therewith.

Figure 7:
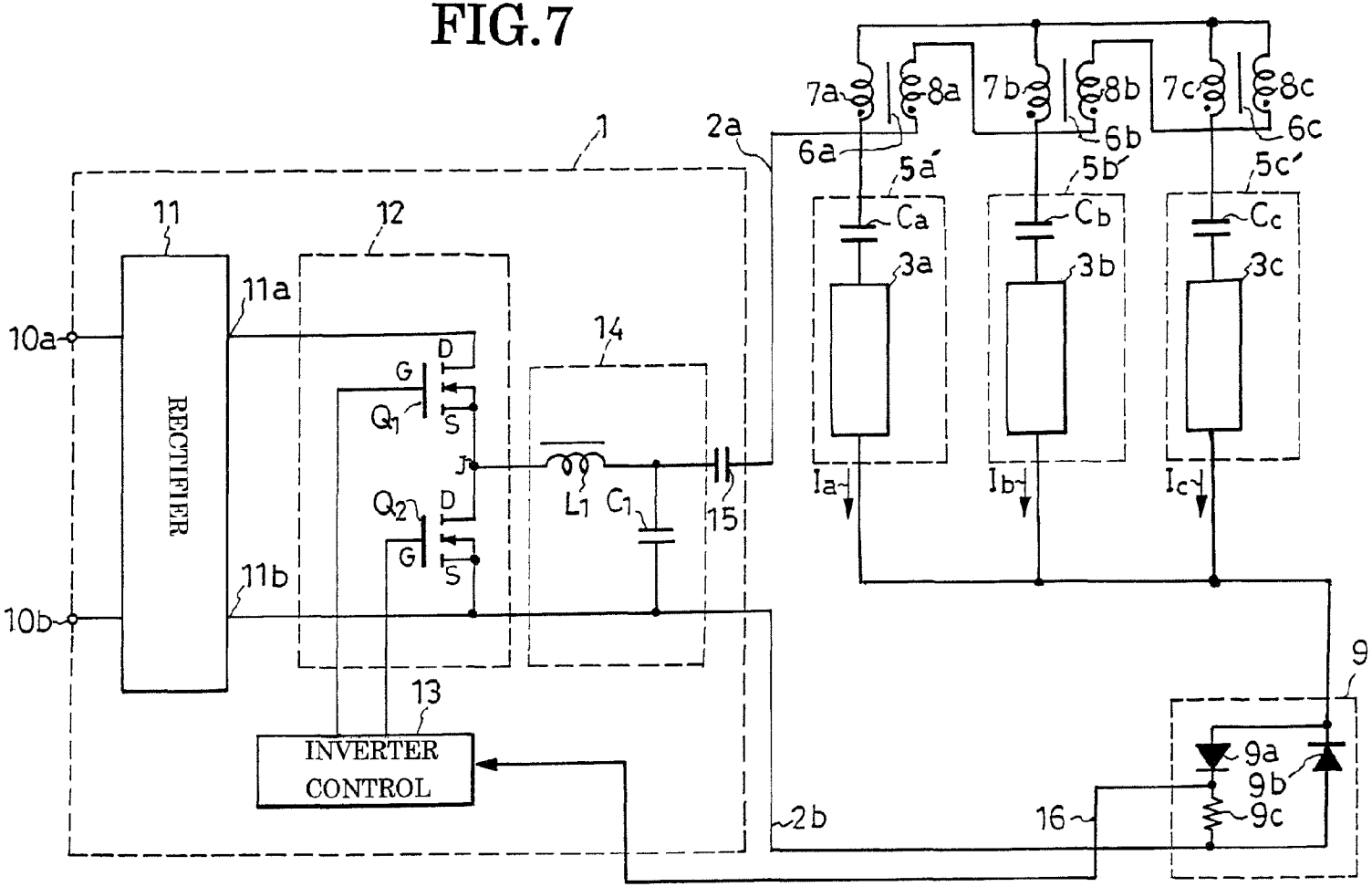
FIG. 7 is a diagram similar to FIG. 2 but showing a further preferred form of gas-discharge lamp igniter according to the invention.

Embodiment of FIG. 7

Here is shown a combination of the embodiments of FIGS. 5 and 6. The load circuits $\mathbf{5}_a'$-$\mathbf{5}_c'$ including the ballast capacitors $C_a$-$C_c$ in addition to the gas-discharge lamps $\mathbf{3}_a$-$\mathbf{3}_c$ as in FIG. 5 are combined with the current-balancing transformers $\mathbf{6}_a$-$\mathbf{6}_c$ of the same placement as those in FIG. 6. This embodiment offers all the benefits of the embodiments of FIGS. 2, 5 and 6.

Figure 8:
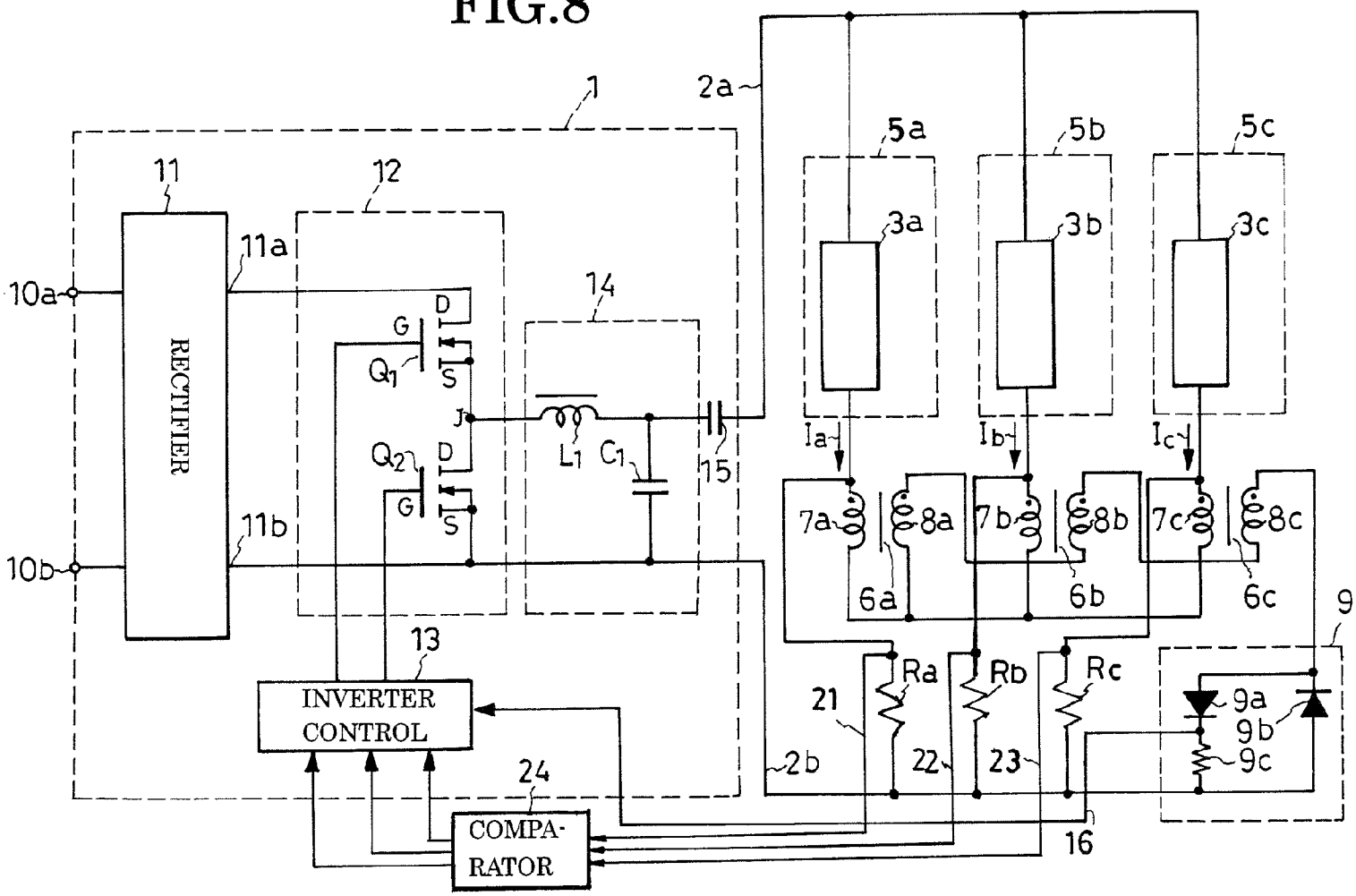
FIG. 8 is a diagram similar to FIG. 2 but showing a still further preferred form of gas-discharge lamp igniter according to the invention.

Embodiment of FIG. 8

This embodiment features load state detector means for automatically suspending the energization of the gas-discharge lamps $\mathbf{3}_a$-$\mathbf{3}_c$ upon detection of any abnormal state in either of these lamps. The load state detector means include resistors $R_a$, $R_b$ and $R_c$ each connected on one hand to the junction between one gas-discharge lamp and one associated current-balancing transformer primary and on the other hand to the output $\mathbf{2}_b$ of the AC power supply network 1. The resistors $R_a$-$R_c$ are individually connected via conductors 21, 22 and 23 to comparator means 24 and thence to the inverter control circuit 13 of the AC power supply network 1. This embodiment is similar to that of FIG. 2 in all the other details of construction.

The resistors $R_a$-$R_c$ serve to provide voltage signals indicative of the states of the respective lamps $\mathbf{3}_a$-$\mathbf{3}_c$, that is, of whether these lamps are each installed or uninstalled, lit or unlit, or lit normally or abnormally, in short, of whether the respective load circuits $\mathbf{5}_a$-$\mathbf{5}_c$ are open or closed. Inputting these voltage signals, the comparator means 24 compares them with a reference. If any of the voltage signals is higher than the reference, the comparator means 24 causes the inverter circuit 13 to turn off the inter circuit 12.

Alternatively, the load state detector means may be connected to a selected or one ones of the current-balancing transformers instead to all the current-balancing transformers. Similar load state detector means may be added to the other gas-discharge lamp igniters disclosed herein.

Possible Modifications

Although the balanced power supply system according to the present invention has been shown and described hereinbefore in terms of some currently preferred forms, it is not desired that the invention be limited by the exact details of these preferred forms or by the description thereof. The following is a brief list of possible modifications of the illustrated embodiments which are all believed to fall within the purview of the instant invention:

1. The invention is applicable to the balanced powering of various forms of resistance or impedance loads in addition to the exemplified gas-discharge lamps.

2. The invention is of particular utility when applied to the energization of greater numbers of loads than shown in the attached drawings.

3. The AC power supply network 1 may be of any known or suitable construction capable of providing an AC voltage. Thus, for example, the half-bridge inverter 12 is replaceable by either a full-bridge or a push-pull inverter or by an inverter of different type wherein a switch connected in series with a transformer primary is rapidly turned on and off to provide an AC voltage across the transformer secondary. The VFO $\mathbf{13}_a$, FIG. 3, of the inverter control circuit 13 is also replaceable by a fixed frequency oscillator.

4. The feedback control of the AC power supply network 1 is not an absolute necessity.

5. It is desirable that the gas-discharge lamps $\mathbf{3}_a$-$\mathbf{3}_c$ be of the same current, voltage and impedance ratings, and the transformers $\mathbf{6}_a$-$\mathbf{6}_c$ be also of the same ratings. However, the invention is applicable if these lamps, or the load circuits $\mathbf{5}_a$-$\mathbf{5}_c$ or $\mathbf{5}_a'$-$\mathbf{5}_c'$, differ in impedance beyond the manufacturing tolerances. In that case the winding turns of the transformers $\mathbf{6}_a$-$\mathbf{6}_c$ may be readjusted for the respective load circuits.

6. The current detector circuit 9 is replaceable by a Hall generator or the like. The Hall generator or the like is coupled to one of the outputs of the AC power supply means.

What is claimed is:

1. An AC power supply system for balanced energization of a plurality of loads, comprising:

(a) an AC power supply device having a first output and a second output for providing an AC supply voltage; and (b) a plurality of current-balancing transformers provided one for each of the plurality of loads, each of the current-balancing transformers having a primary winding and a secondary winding electromagnetically coupled together, each primary winding connected in series to each of the plurality of loads to form a plurality of first series circuits, each of the first series circuits connected in parallel to one another to form a parallel circuit, and each secondary winding connected in series to one another to form a second series circuit, one end of the second series circuit connected to one end of the parallel circuit to form a load circuit, wherein the load circuit is connected to the AC power supply device, one end of the load circuit is connected to the first output of the AC power supply device, and the other end of the load circuit is connected to the second output of the AC power supply device.

2. An AC power supply system as recited in claim 1, wherein the ratio of the turns in the primary winding of each current-balancing transformer to the turns in the secondary winding thereof is n/1 where n is the number of the loads to be energized.

3. An AC power supply system as recited in claim 1, further comprising a load state detector circuit comprising:

(a) a voltage detector connected to at least one of the primary windings for providing a voltage signal indicative of the state of at least one of the loads; and (b) a comparator for comparing the load state signal from the voltage detector with a reference voltage.

4. An AC power supply system as recited in claim 1, wherein the AC power supply device comprises an inverter and a resonant circuit connected between the inverter and the first and the second output of the AC power supply device.

5. An AC power supply system as recited in claim 4, further comprising a feedback control loop comprising:

(a) a current detector coupled to at least one of the first and the second outputs of the AC power supply device for detecting a current to flow through the load circuit; and (b) an inverter control circuit connected between the current detector and the inverter of the AC power supply device for controlling the current to flow through the load circuit in response to an output signal from the current detector.

6. A lamp igniter for balanced energization of electric lamps, comprising:

(a) a power supply device having a first output and a second output for providing an AC supply voltage; and (b) a plurality of current-balancing transformers provided one for each of the electric lamps to be energized, each of the current-balancing transformers having a primary winding and a secondary winding electromagnetically coupled together, each primary winding connected in series to each of the electric lamps to form a plurality of first series circuits, and each of the first series circuits connected in parallel to one another to form a parallel circuit, each secondary winding being connected in series to one another to form a second series circuit, one end of the second series circuit being connected to one end of the parallel circuit to form a load circuit, wherein the load circuit is connected to the AC power supply device, one end of the load circuit is connected to the first output of the AC power supply device and the other end of the load circuit is connected to the second output of the AC power supply device.

7. A lamp igniter as recited in claim 6, further comprising a plurality of ballast capacitors each connected in series with one of the lamps.

* * * * *